US008336267B2

(12) United States Patent
Montague et al.

(10) Patent No.: US 8,336,267 B2
(45) Date of Patent: Dec. 25, 2012

(54) CONSTRUCTION FRAME SHEAR LUG

(75) Inventors: Emory L Montague, Pleasanton, CA (US); Paul McEntee, Fremont, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 59 days.

(21) Appl. No.: 12/262,754

(22) Filed: Oct. 31, 2008

(65) Prior Publication Data

US 2010/0107545 A1 May 6, 2010

(51) Int. Cl.
*E02D 27/32* (2006.01)

(52) U.S. Cl. ..... 52/295; 52/296

(58) Field of Classification Search ..... 52/295, 52/296, 283, 223.13
See application file for complete search history.

(56) References Cited

U.S. PATENT DOCUMENTS

| | | | | |
|---|---|---|---|---|
| 3,993,341 | A * | 11/1976 | Bentley | 294/89 |
| 4,750,306 | A * | 6/1988 | Granieri | 52/251 |
| 5,402,616 | A * | 4/1995 | Klein | 52/601 |
| 6,763,646 | B1 * | 7/2004 | Bonomo | 52/649.6 |
| 6,854,232 | B2 * | 2/2005 | Snauwaert | 52/582.1 |
| 2003/0009964 | A1 * | 1/2003 | Trarup et al. | 52/295 |
| 2005/0284083 | A1 | 12/2005 | Gridley et al. | |
| 2009/0014621 | A1 * | 1/2009 | Baten | 248/674 |

FOREIGN PATENT DOCUMENTS

| | | | |
|---|---|---|---|
| EP | 0943745 | A2 | 9/1999 |
| FR | 1169752 | A | 1/1959 |
| GB | 2412927 | A | 10/2005 |

OTHER PUBLICATIONS

International Search Report & The Written Opinion of the International Searching Authority dated Feb. 11, 2010 in International Application No. PCT/US2009/062596.
Examination Report dated May 4, 2012 in New Zealand Patent Application No. 592327.

* cited by examiner

*Primary Examiner* — Jeanette E Chapman
*Assistant Examiner* — Daniel Kenny
(74) *Attorney, Agent, or Firm* — Vierra Magen Marcus & DeNiro LLP

(57) ABSTRACT

A shear lug is disclosed for transferring shear stresses from a structural element, such as a column in a framing element, down into the foundation supporting the framing element. The shear lug is not initially affixed to the structural element. The shear lug is instead affixed to anchor rods of an anchorage assembly, and is installed into the foundation with the anchorage assembly at the time the concrete foundation is poured. The structural element is subsequently affixed to the anchor rods, so that shear forces are transferred from the structural element, through the anchor rods and to the shear lugs, which effectively dissipate the shear forces to the foundation.

24 Claims, 10 Drawing Sheets

Fig. 17
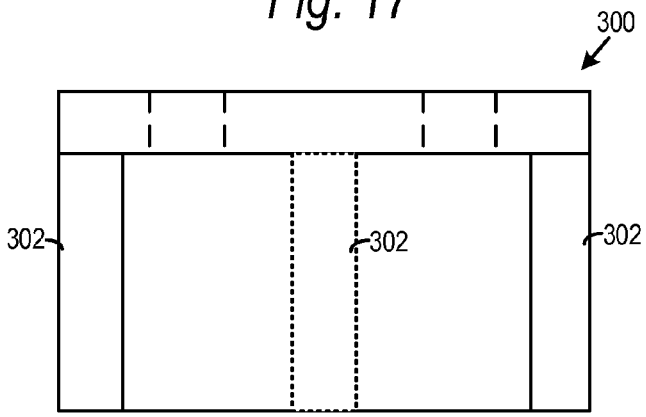
Fig. 18
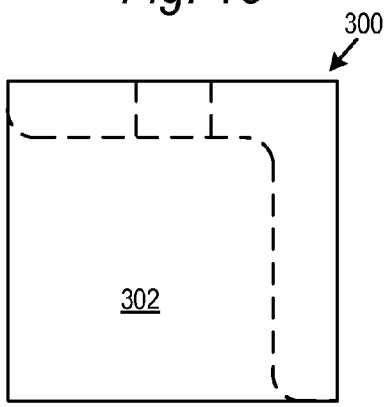
Fig. 19
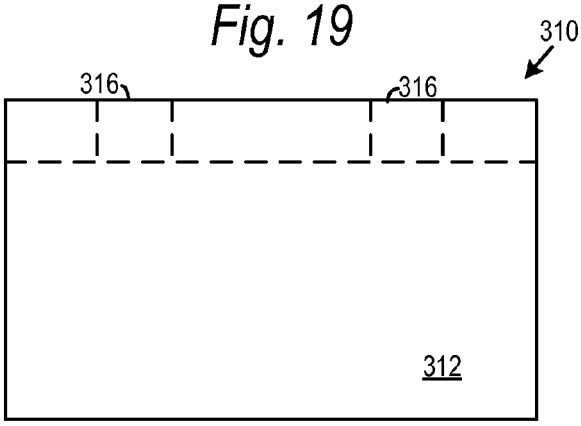
Fig. 20
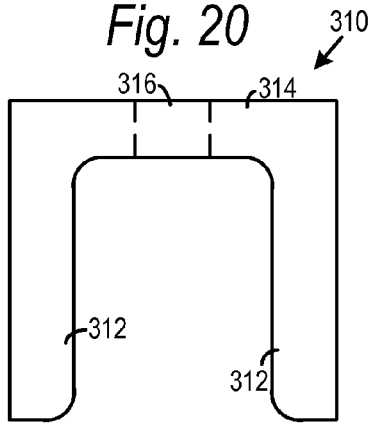
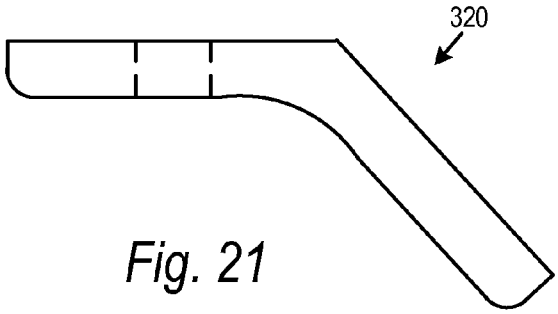
Fig. 21

CONSTRUCTION FRAME SHEAR LUG

BACKGROUND OF THE INVENTION

1. Field of the Invention

The present invention relates to load bearing in the construction of buildings and in particular to a shear lug for transmitting shear forces from framing elements to a foundation on which the framing elements are supported.

2. Description of the Related Art

Framing elements used for example in lightweight constructions are mounted to foundations so as to resist a variety of forces. An example of a framing element 20 is shown in prior art FIG. 1 mounted to a foundation 22. Lateral loads, L, may be exerted on the framing element 20, for example upon seismic activity or winds. The lateral loads L as shown generate tensile forces T and compressive loads C on respective columns 24 of the framing element 20 as shown. In order to transfer the tensile loads from the column 24 to the foundation 22, anchor rods 30 are bolted to the column base and extend through the base down into the concrete foundation.

In addition to the tensile and compressive forces, lateral loads may also generate shear forces, S, transverse to the length of the column at the column base. In some constructions, the frictional forces generated by the axial compressive loads on the frame columns are sufficient to oppose the shear forces. However, for constructions bearing higher shear forces, a variety of structures and methods are known for transferring these shear forces to the foundation. Such structures and methods include embedding the column itself into the foundation and providing anchor bolts to provide a clamping force resisting shear loads.

A third alternative is to provide a shear lug mounted to the base of the frame column. Prior art FIG. 2 shows a shear lug 40 mounted to the base plate 42 of a column 24 and positioned in the foundation 22. The shear lug 40 is in general a plate, or fin, welded perpendicularly to the bottom of the base plate 42. In practice, the base plate and shear lug are first bolted to the bottom of the column. A trench, or key, 46 is then formed in the foundation having a depth and width larger than the height and width of the shear lug. The base plate is then positioned atop the foundation, with the shear lug positioned within the key. A layer of grout 48 is provided to fill the key and a space between the base plate and foundation. With this structure, shear force is transferred from the column base, through the base plate and shear lug, into the grout and foundation, with the shear lug acting as a cantilever to transfer shear down into the foundation.

The use of a shear lug in this conventional manner has certain drawbacks. For example, fitting the shear lug to a preformed key in the foundation weakens the foundation and reduces the ability of the foundation to absorb the applied shear forces. At times, a wedge of the foundation can shear off, especially where the column and shear lug are close to an edge of the foundation. Additionally, the weld of the shear lug to the base plate is subject to high stresses and can at times fail under high shear loads.

SUMMARY OF THE INVENTION

Embodiments of the present invention relate to a shear lug for transferring shear stresses from a structural element, such as a column in a framing element, down into the foundation supporting the framing element. The shear lug is not initially affixed to the structural element. The shear lug is instead affixed to anchor rods of an anchorage assembly, and is installed into the foundation with the anchorage assembly at the time the concrete foundation is poured. The structural element is subsequently affixed to the anchor rods, so that shear forces are transferred from the structural element, through the anchor rods and to the shear lugs, which effectively dissipate the shear forces to the foundation.

A shear lug according to embodiments of the present invention is more effective at distributing shear loads from structural elements to the foundation than conventional shear lugs. In particular, as the present shear lug is mounted within the foundation when the foundation is poured, and subsequently attached to the structural element, the likelihood that the shear lug will fracture the foundation is reduced. Moreover, as the present shear lug is formed of a unitary angled piece of steel, as opposed to a fin welded onto a base plate, the problem of weld failure is alleviated.

A first embodiment of the shear lug includes a horizontal leg and a vertical leg extending down at an angle to the horizontal leg. The horizontal portion includes a pair of holes for receiving a pair of anchor rods therethrough. For structures subject to higher shear and/or tensile forces, a second embodiment of the present invention may include an anchorage assembly having four anchor rods and a shear lug including four holes for receiving the four anchor rods.

BRIEF DESCRIPTION OF THE DRAWINGS

FIGS. 17-21 are front and end views of shear lugs according to further alternative embodiments of the present invention.

DETAILED DESCRIPTION

The present invention will now be described with reference to FIGS. 3 through 21, which in embodiments relate to a shear lug for transferring shear loads from framing members to a foundation on which the framing member is supported. It is understood that the present invention may be embodied in many different forms and should not be construed as being limited to the embodiments set forth herein; rather these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

Figure 1:
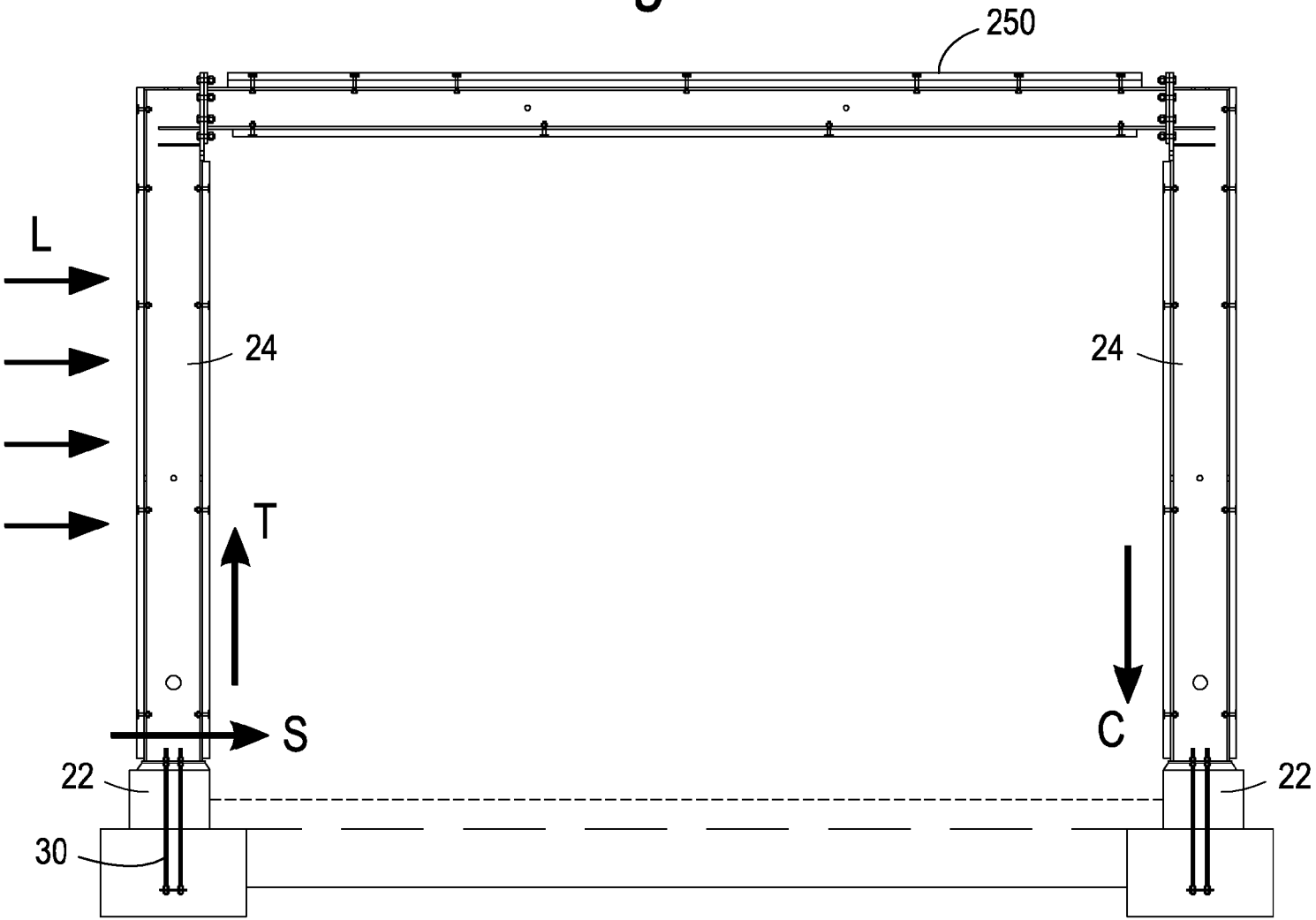
FIG. 1 is a prior art front view of a framing element undergoing tensile, compressive and shear forces.
Figure 2:
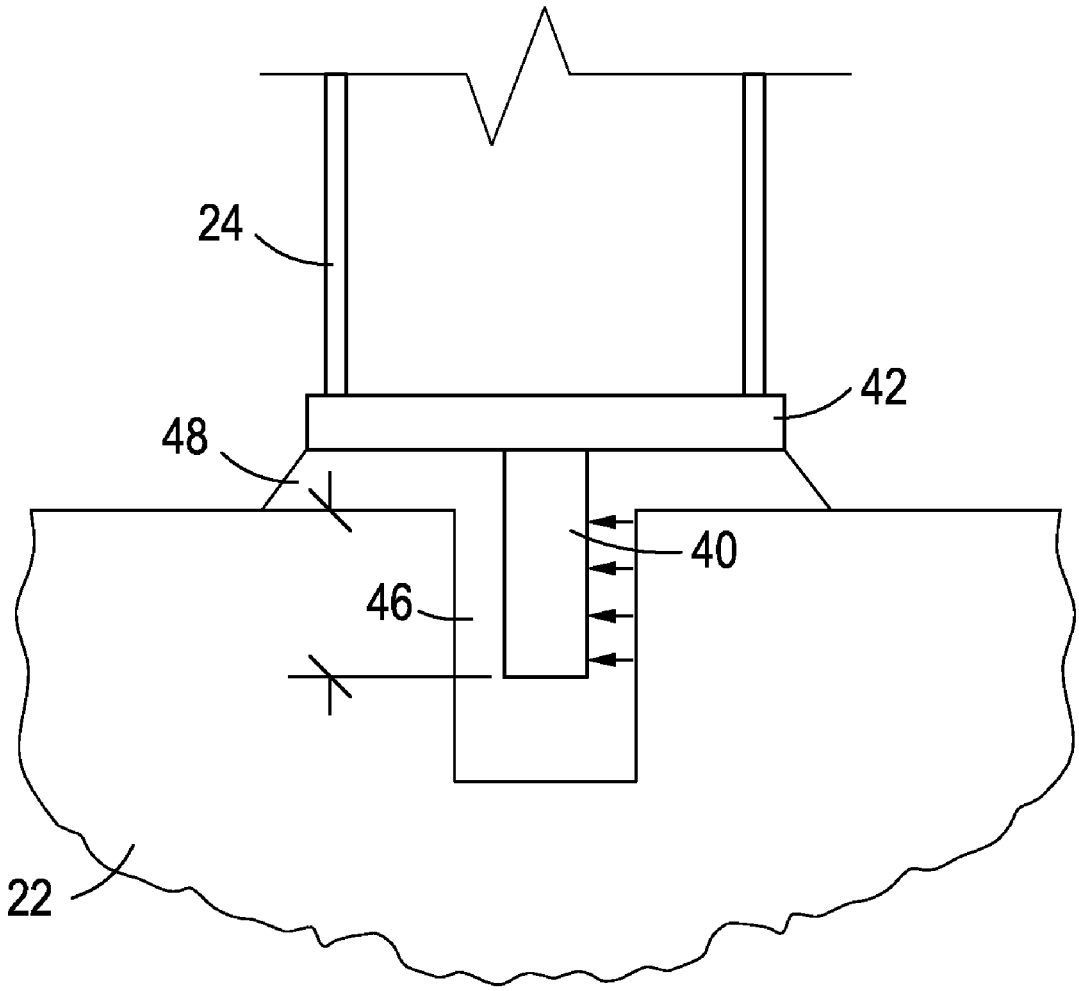
FIG. 2 is prior art edge view of a conventional shear lug positioned between a column base and the foundation.
Figure 3:
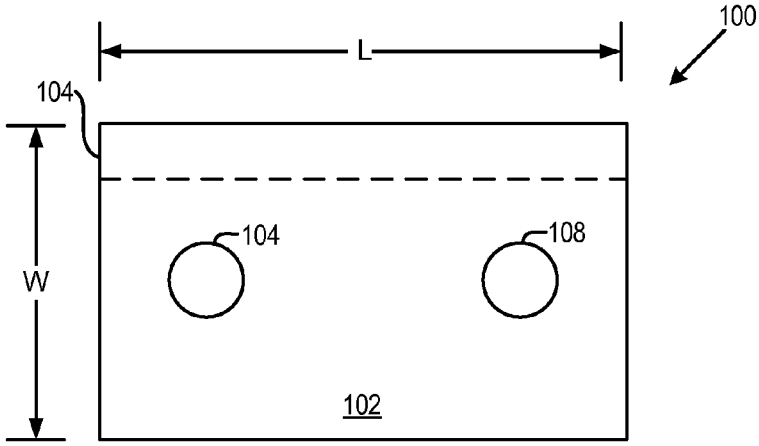
FIGS. 3-5 are top, front and edge views, respectively, of a shear lug according to embodiments of the present invention.
Figure 4:
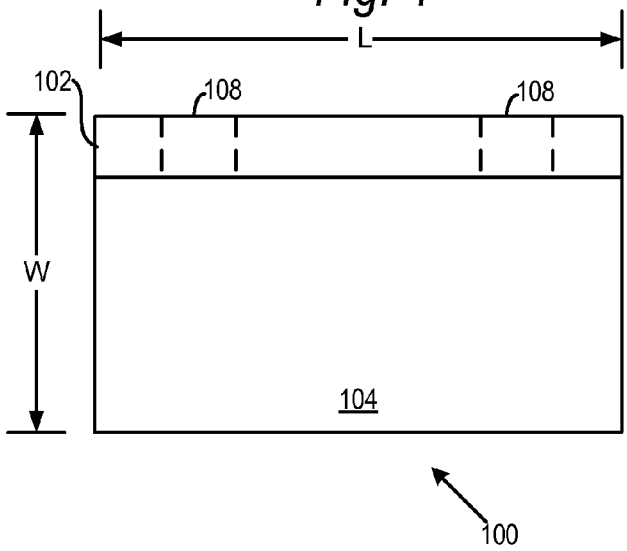
Figure 5:
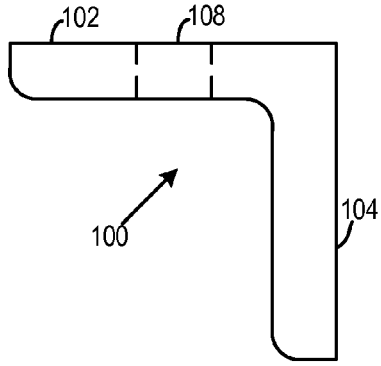

Embodiments of the present invention will now be described with reference to FIGS. 3-21. FIGS. 3-9 illustrate a first embodiment of a shear lug operating with a pair of anchor rods, FIGS. 10-16 illustrate a further embodiment of a shear lug operating with four anchor rods and FIGS. 17-21 illustrate still further embodiments of the shear lug according to the present invention. Referring initially to FIGS. 3-5, there is shown top, front and side views, respectively, of a shear lug 100 for operating with a pair of anchor rods. In embodiments, shear lug 100 may be a right angle piece of steel including a horizontal leg 102 and a vertical leg 104. The horizontal and vertical legs may be welded to each other in further embodiments. Where formed of separate pieces, the vertical leg may extend down from an end of the horizontal leg, or from a middle portion of the leg (similar to the shear lug 200 described below with respect to FIGS. 10-16). References to vertical and horizontal herein are with respect to an installed shear lug and these terms are not to be considered limiting on the present invention.

In embodiments, each of the horizontal and vertical legs 102, 104 may have a length, L of approximately five inches, a width, W, of approximately three inches and a thickness of one-half inch. The horizontal leg 102 includes a pair of holes 108 for receiving anchor rods as explained hereinafter. Holes 108 may be centered with respect to the width dimension of the horizontal leg 102, and each may be spaced inward one inch from the edges of the horizontal leg with respect to a length of the horizontal leg. Holes 108 may have a diameter of approximately 0.7 inches. It is understood that each of the above-described dimensions may vary, either proportionately or disproportionately with respect to each other, in alternative embodiments of the present invention. Shear lug 100 may be formed of ASTM A36 steel, but it is understood that shear lug 100 may be formed of other materials in further embodiments of the present invention.

Figure 6:
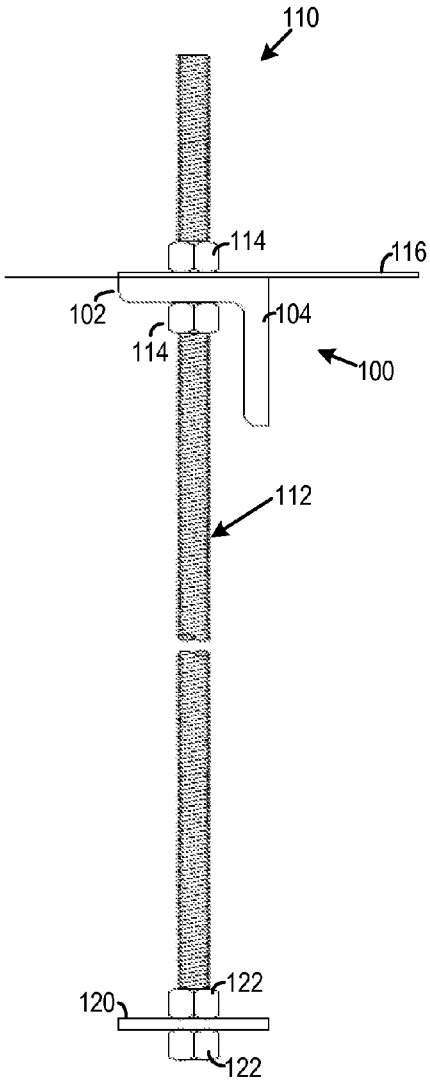
FIGS. 6 and 7 are side and front views, respectively, of an anchor bolt assembly including a shear lug mounted in the foundation according to embodiments of the present system.
Figure 7:
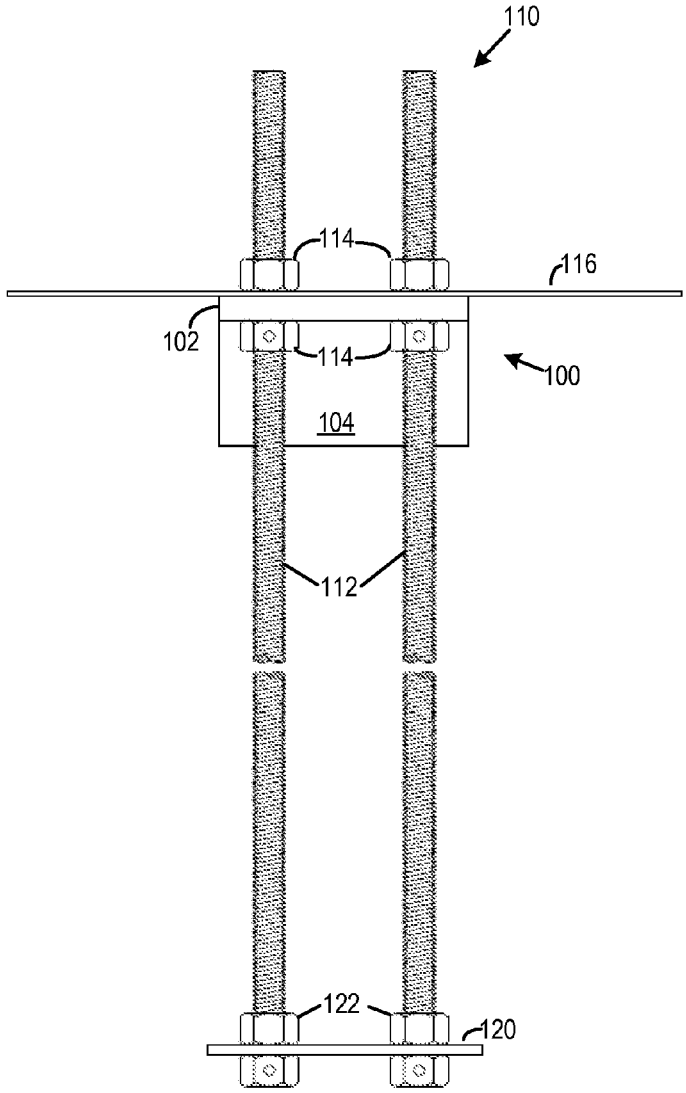

FIGS. 6 and 7 illustrate side and front views, respectively, of an anchorage assembly 110 including a shear lug 100 according to embodiments of the present invention. In the embodiment of FIGS. 3-9, anchorage assembly 110 includes a pair of anchor rods 112 having a diameter capable of fitting snugly within holes 108 in the horizontal leg 102 of shear lug 100. The anchor rods 112 are fixed with respect to shear lug 100 by a pair of hex nuts 114 threaded over the anchor rods and clamping top and bottom surfaces of the horizontal leg 102 of shear lug 100. A template 116 is further clamped between the top hex nut 114 and a top surface of the horizontal leg 102, the purpose of which template is to position the anchorage assembly 110 with respect to a concrete foundation as explained hereinafter.

In embodiments, each anchor rod 112 may have a ⅝ inch diameter and a length varying from fourteen inches to thirty-six inches. It is understood the diameter of rods 112 and the length of rods 112 may vary above or below these dimensions in further embodiments. In embodiments, the hex nuts 114 fasten the shear lug 100 onto anchor rods 112 so that the anchor rods extend approximately 4½ inches above the upper surface of the horizontal leg 102. It is understood that the length of rods 112 extending above the upper surface of leg 102 may be more or less than 4½ inches in further embodiments of the present invention. A bearing plate 120 may be fastened to bottom portions of anchor rods 112 via a pair of hex nuts 122 on each rod. Bearing plate 120 is provided to transfer tensile loads on anchor rods 112 to a foundation within which anchorage assembly 110 is buried as explained below.

Figure 8:
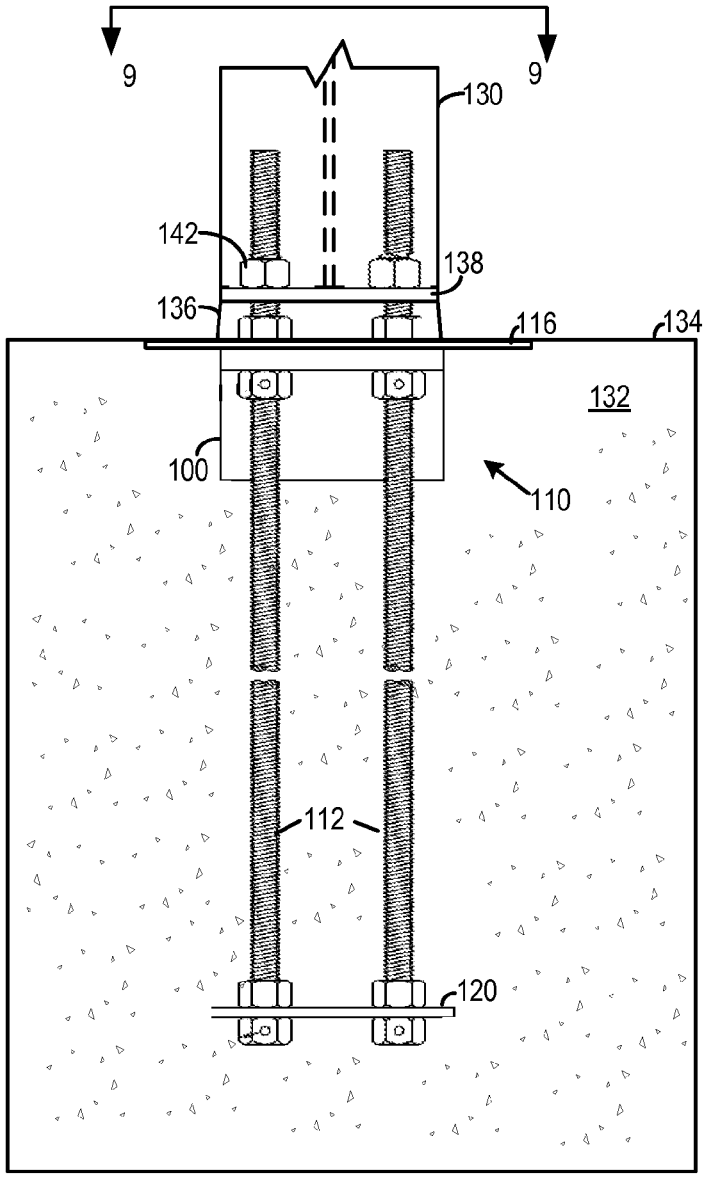
FIG. 8 is a front view of a shear lug and anchor bolt assembly mounting a column to the foundation according to embodiments of the present invention.
Figure 9:
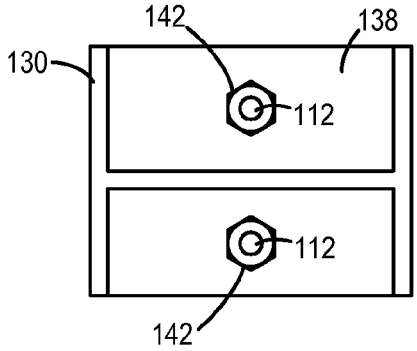
FIG. 9 is a cross-sectional top view through line 9-9 of FIG. 8.

FIG. 8 is a front view of a structural element 130 mounted to a foundation 132 via anchorage assembly 110. FIG. 9 is a cross-sectional top view of the structural element through line 9-9 in FIG. 8. Structural element 130 may for example be a column included as part of a structural frame. Prior to positioning of structural element 130, anchorage assembly 110 is positioned within concrete foundation 132 as the concrete foundation 132 is poured. In particular, in order to provide the concrete foundation, forms (typically plywood sheets—not shown) are positioned around the sides and upper surface of the area to be filled with concrete. Template 116, to which the anchorage assembly 110 is affixed, is mounted flush against a bottom surface of a form used to define a top surface 134 of the foundation 132. In embodiments, the template may be nailed to the form. Accordingly, after the concrete foundation 132 sets and the form is removed, the template 116 is flush against the top surface 134 of foundation 132. In this manner, the anchor rods 112 and the shear lug 100 get properly positioned, embedded within foundation 132. It is understood that the foundation 132 may be formed of materials other than concrete that are poured and which set around the anchorage assembly 110.

Figure 16:
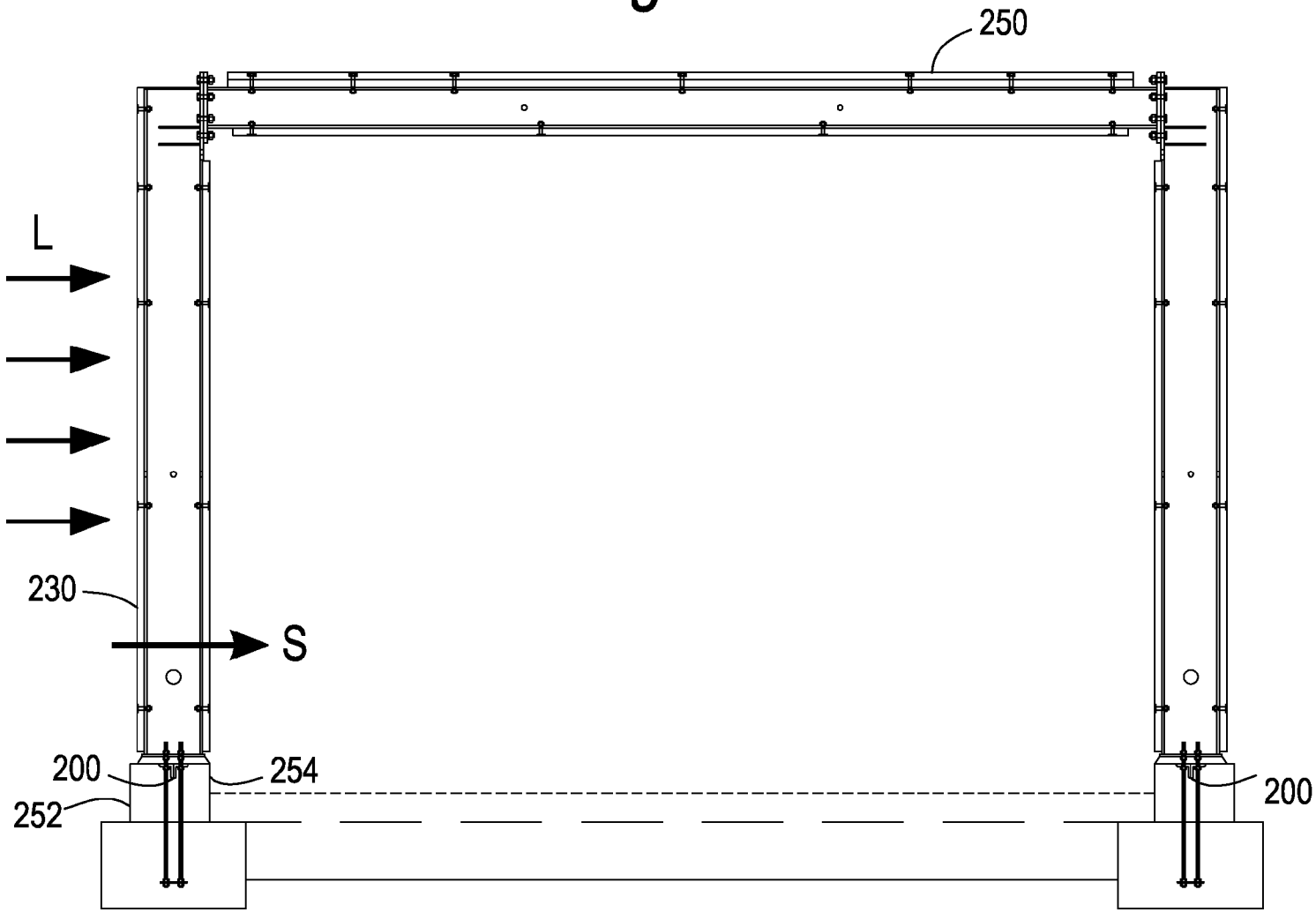
FIG. 16 is a front view of a framing element including shear lugs according to embodiments of the present invention.

Thereafter, a structural element 130 may be mounted to the anchorage assembly 110. Structural element 130 may be part of a frame such as shown in FIG. 16, aligned in a plane perpendicular to the drawing of FIG. 8. Structural element 130 may for example be part of a Strong Frame™ ordinary moment frame manufactured by Simpson Strong-Tie Co., Inc. of Pleasanton, Calif. Structural element 130 may however be part of a wide variety of other types of structural frames. It is also contemplated that structural element 130 need not be formed as part of a frame. In embodiments, structural element 130 may be any structural element used in a construction that is subjected to shear forces at its base.

Structural element 130 includes a base plate 138 welded or otherwise affixed to a bottom of the element 130. In the embodiment of FIG. 8, base plate 138 includes a pair of holes through which the anchor rods 112 extend above the foundation 132. When structural element 130 is affixed over anchor rods 112, a space beneath base plate 138 may be filled in with a layer of grout 136. A pair of hex nuts 142 may then be fastened over anchor rods 112 flush against the base plate to secure structural element 130 in place.

Shear lug 100 in the embodiments of FIGS. 3-9 is more effective at distributing shear loads from structural element 130 to foundation 132 than conventional shear lugs. In particular, as shear lug 100 is mounted within foundation 132 when the foundation is poured, and subsequently attached to structural element 130, the likelihood that the shear lug 100 will fracture foundation 132 is reduced. This is in part due to the fact that, as the shear lug 100 is positioned within the foundation before it sets, the foundation lies in direct contact with the first and second surfaces of the vertically oriented leg 104. Moreover, as shear lug 100 is formed of a unitary angled piece of steel in embodiments, as opposed to a fin welded onto a base plate, the problem of weld failure is alleviated. As indicated above, the shear lug may be formed of welded-together components in further embodiments.

In operation, shear exerted on structural element 130 is transmitted to the portion of the anchor rods 112 above surface 134 of foundation 132, and from that portion of the anchor rods down into shear lug 100, which distributes the shear forces into the foundation. In embodiments, anchor rods 112 are provided with sufficient strength to transmit shear from the structural element 130 to the shear lug 100. This may be accomplished by forming anchor rods 112 of a high strength steel and/or using a sufficiently large diameter for anchor rods 112. While it may be desirable to have shear lug 100 generally flush with the upper surface of the foundation to minimize the amount of shear forces borne by the anchor rods, it is understood that the shear lug 100 may be buried deeper within the foundation (i.e., spaced from template 116) in alternative embodiments of the present invention.

Figure 10:
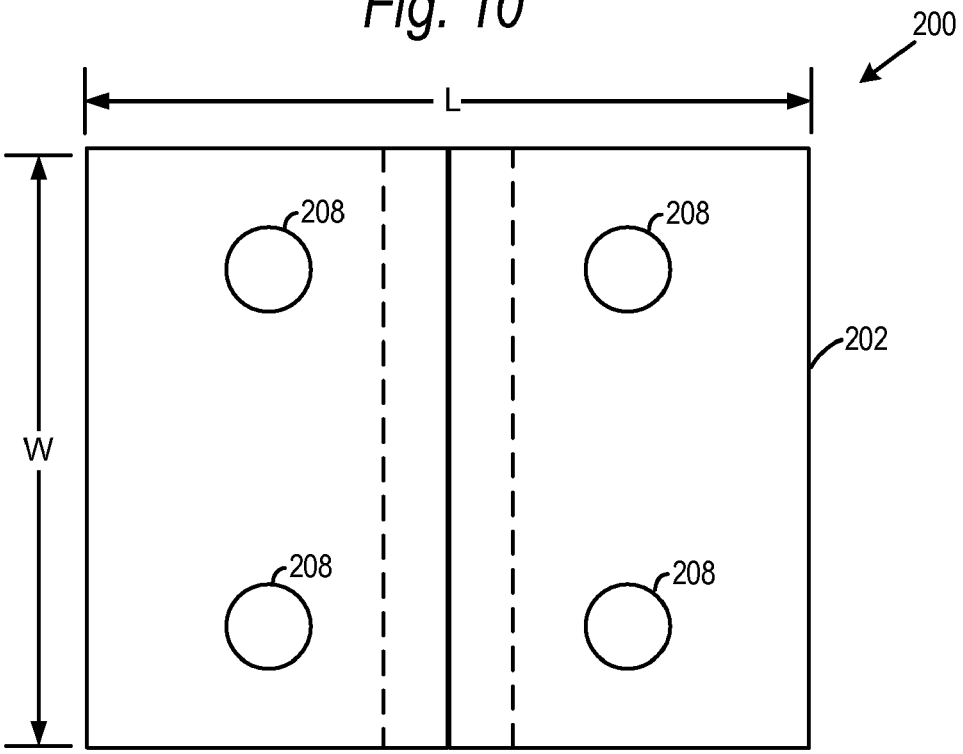
FIGS. 10 and 11 are top and side views, respectively, of a shear lug according to an alternative embodiment of the present invention.
Figure 11:
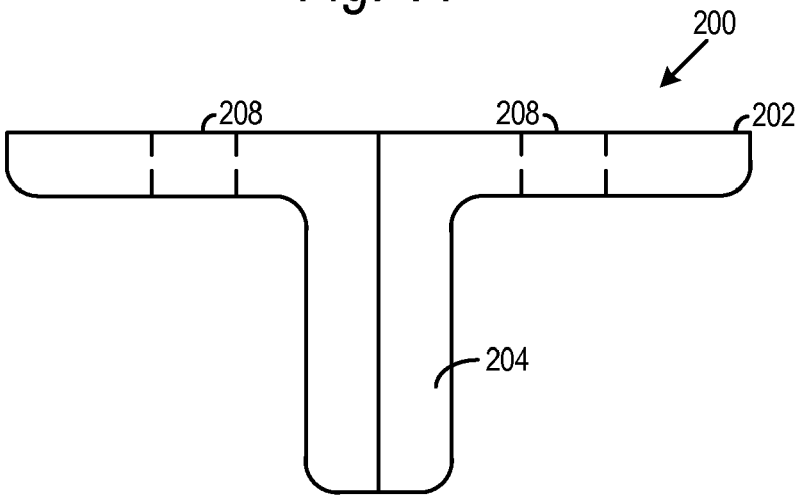

In the embodiments described above with respect to FIGS. 3-9, shear lug 100 included two holes 108 for receiving two anchor rods 112. However, it may happen that structural element 130 is wider and/or subjected to larger shear and/or tensile forces. Accordingly, further embodiments of the present invention may include an anchorage assembly having four anchor rods and a shear lug including four holes for receiving the four anchor rods. Such an embodiment is shown and described with respect to FIGS. 10-16. FIGS. 10 and 11 are top and side views, respectively, of a shear lug 200 including an upper horizontal portion 202 and a downwardly extending vertical portion 204. In embodiments, the shear lug 200 may be a pair of shear lugs 100, as shown in FIGS. 3-9, wherein the vertical legs 104 are welded together back to back to form shear lug 200. In alternative embodiments, shear lug 200 may be a unitary piece of steel including horizontal portion 202 and a vertical portion 204 extending down from a central section of the horizontal portion 202.

Holes 208 are provided in the horizontal portion 202 of shear lug 200. In embodiments, shear lug 200 may have a length, L, of six inches and a width, W, of five inches. Holes 208 may have center points located 1½ inches from an edge of the horizontal portion along the length dimension, and the holes 208 may have center points located one inch from the edge of horizontal portion 202 along the width dimension. Horizontal portion 202 may have a thickness of approximately one-half inch and vertical portion 204 may have a thickness of between approximately one-half inch and one inch. It is understood that each of the above-described dimensions of shear lug 200 may vary, both proportionately and disproportionately with respect to each other, in alternative embodiments. Shear lug 200 may be formed of ASTM A36 steel but it is understood that shear lug 200 may be formed from alternative materials in alternative embodiments.

Figure 12:
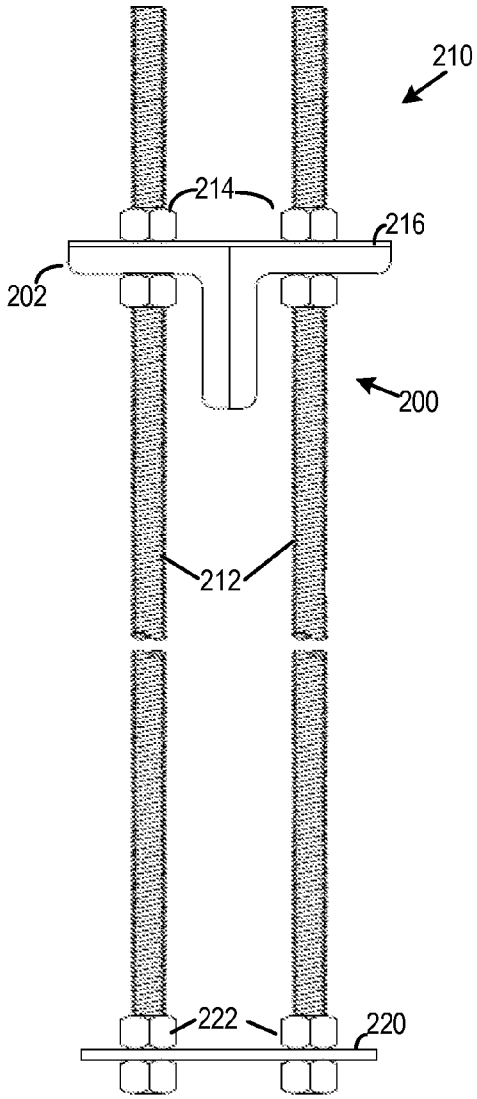
FIGS. 12 and 13 are side and front views, respectively, of an anchor bolt assembly including a shear lug mounted in the foundation according to the alternative embodiment of FIGS. 10 and 11.
Figure 13:
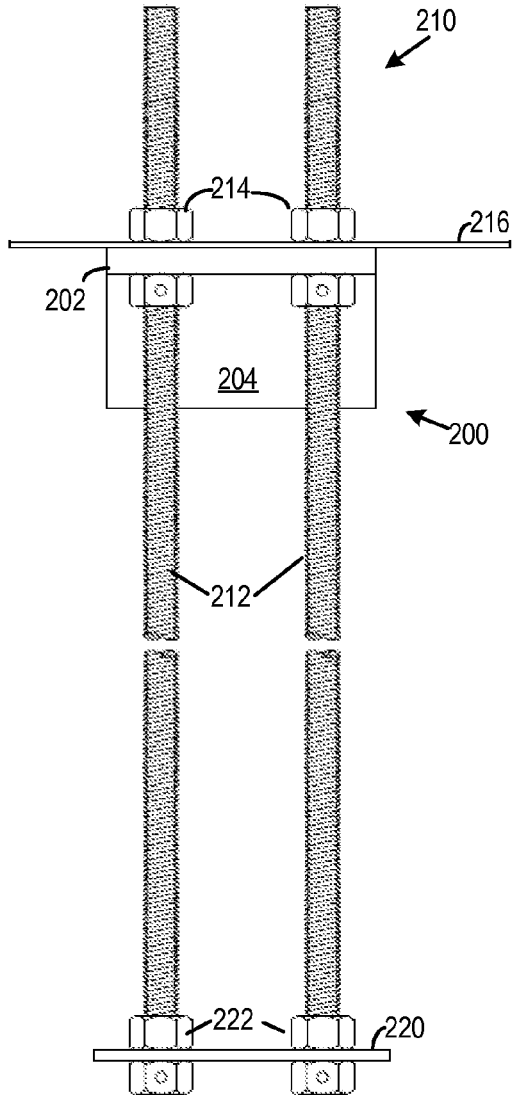

FIGS. 12 and 13 show side and front views, respectively, of an anchorage assembly 210 including shear lug 200 and four anchor rods 212 (in each of FIGS. 12 and 13, two anchor rods 212 are shown and two are blocked from view). In the embodiment of FIGS. 10-16, anchorage assembly 210 includes four anchor rods 212 having a diameter capable of fitting snugly within respective holes 208 in the horizontal portion 202 of shear lug 200. Each of the anchor rods 212 is fixed with respect to shear lug 200 by a pair of hex nuts 214 threaded over the anchor rods and clamping top and bottom surfaces of the horizontal portion 202 of shear lug 200. A template 216 is further clamped between the top hex nut 214 and a top surface of the horizontal portion 202 for positioning the anchorage assembly 210 with respect to a concrete foundation.

In embodiments, each anchor rod 212 may have a ⅝ inch diameter and a length varying from eighteen inches to thirty-six inches. It is understood the diameter of rods 212 and the length of rods 212 may vary above or below these dimensions in further embodiments. In embodiments, the hex nuts 214 fasten the shear lug 200 onto anchor rods 212 so that the anchor rods extend approximately 4½ inches above the upper surface of the horizontal portion 202. It is understood that the length of rods 212 extending above the upper surface shear lug 200 may be more or less than 4½ inches in further embodiments of the present invention. A bearing plate 220 may be fastened to bottom portions of anchor rods 212 via a pair of hex nuts 222 on each rod. As in the above-described embodiment, bearing plate 220 is provided to transfer tensile loads on anchor rods 212 to the foundation.

Figure 14:
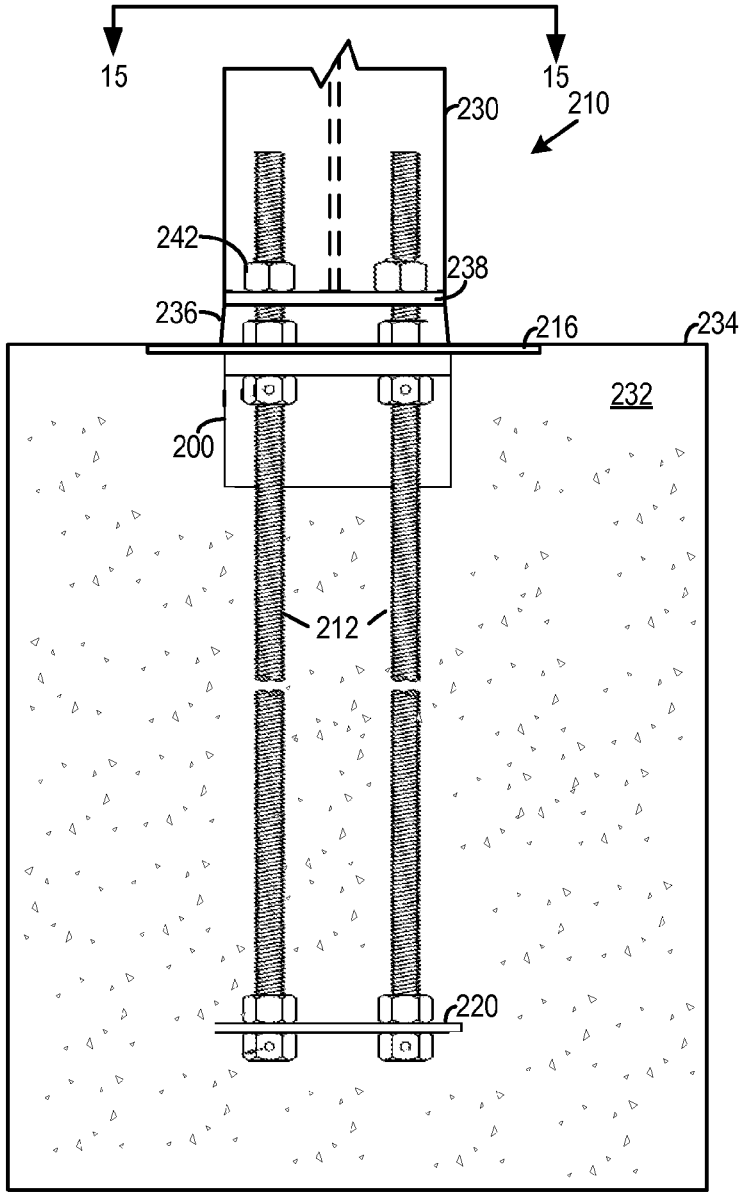
FIG. 14 is a front view of a shear lug and anchor bolt assembly mounting a column to the foundation according to the alternative embodiment of FIGS. 10 and 11.
Figure 15:
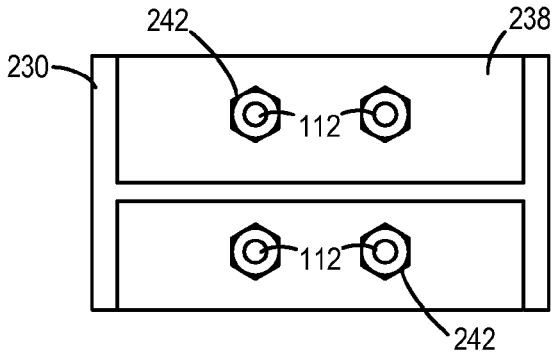
FIG. 15 is a cross-sectional top view through line 15-15 of FIG. 14.

FIG. 14 is a front view of a structural element 230 mounted to a foundation 232 via anchorage assembly 210. FIG. 15 is a cross-sectional top view of the structural element through line 15-15 in FIG. 14. Structural element 230 may for example be a column included as part of a structural frame 250, shown for example in FIG. 16 and described below. Prior to positioning of structural element 230, anchorage assembly 210 is positioned within concrete foundation 232 as the concrete foundation 232 is poured. Template 216, to which the anchorage assembly 210 is affixed, is mounted flush against a bottom surface of a form used to define a top surface of the foundation 232. Accordingly, after the concrete foundation 232 sets and the form is removed, the template 216 is flush against the top surface 234 of foundation 232. In this manner, the anchor rods 212 and the shear lug 200 get properly positioned, embedded within foundation 232.

Thereafter, a structural element 230 may be mounted to the anchorage assembly 210. As with framing element 130, element 230 may be a column in a Strong Frame™ ordinary moment frame manufactured by Simpson Strong-Tie Co., Inc. of Pleasanton, Calif., or part of a wide variety of other structural frames. In further embodiments, structural element 230 may be any structural element used in a construction that is subjected to shear forces at its base.

Structural element 230 includes a base plate 238 welded or otherwise affixed to a bottom of the element 230. In the embodiment of FIGS. 14 and 15, base plate 238 includes four holes through which four anchor rods 212 extend above the foundation 232. When structural element 230 is affixed over anchor rods 212, any space beneath base plate 238 may be filled in with a layer of grout 236. A pair of hex nuts 242 may then be fastened over anchor rods 212 flush against the base plate to secure structural element 230 in place.

The embodiment described with respect to FIGS. 3-9 may for example be used with a structural element 130 having a six inch width, whereas the embodiment described with respect to FIGS. 10-15 may for example be used with a structural member having a width of between nine and fifteen inches. It is understood that the embodiment of FIGS. 3-9 may operate with a four anchor rod configuration, and that the embodiment of FIGS. 10-15 may operate with a two anchor rod configuration, in further embodiments. The respective embodiments of FIGS. 3-9 and 10-15 may be used with structural members having widths above or below those set forth above in further alternative embodiments of the present invention. In still further embodiments of the present invention, it is understood that a shear lug may be provided having one hole or more than four holes and operate with a like number of anchor rods in the anchorage assembly.

FIG. 16 shows a frame 250 including a shear lug 200. Frame 250 may alternatively be formed with a shear lug 100. The shear lug 200 shown in FIG. 16 transfers shear forces S from structural element 230 down into the foundation. As shear forces may be generated in either the direction shown or in the opposite direction, it is desirable to have the downwardly extending portion of the shear lug 200 as far from both edges 252 and 254 of the foundation 232 as possible. It is understood that the downwardly extending portion of the shear lug 200 may be closer to one edge 252/254 than the other in further embodiments. Given the enhanced performance of the shear lug of the present invention, in embodiments, structural element 130 may be positioned right at edge 252 and/or edge 254 of the foundation.

FIGS. 17-21 show further alternative embodiments of shear lugs which may be used in accordance with the present invention. FIGS. 17 and 18 show front and side views, respectively, of a shear lug 300 which may be identical to shear lug 100 except that instead of simply being an L-shaped member, the shear lug 300 includes end caps 302 which may be substantially rectangular members engaging both the horizontal leg and vertical leg of the shear lug. As shown in FIG. 17, the end caps 302 may be positioned at both ends of the shear lug. In addition to or instead of those end caps, a similarly shaped member 302 may be affixed at a central portion of the shear lug as shown by the dash lines in the central member 302 in FIG. 17.

A further alternative embodiment is shown in the side view and end view of FIGS. 19 and 20, respectively. In FIGS. 19 and 20, the shear lug 310 comprises a U-shaped channel including a pair of downwardly extending legs 312 and a horizontal leg 314. Holes 316 may be provided in the horizontal portion for receiving anchor rods as described above.

FIG. 21 shows an end view of a further embodiment of a shear lug 320. Shear lug 320 is identical to shear lug 100 shown in FIGS. 3-9, with the exception that the angle between the two different sections is some angle other than ninety degrees. While shown as being greater than ninety degrees in FIG. 21, it is contemplated that the angle may be less than ninety degrees in further embodiments.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An anchorage assembly within a foundation, the anchorage assembly supporting a wall and comprising:

an anchor rod installed in the foundation with a portion of the anchor rod extending out of the foundation; and a shear lug having a first component including a hole receiving the anchor rod to affix the one or more anchor rods directly to the shear lug, the first component having a first edge and a second edge opposite the first edge, and a second component extending from the first component at an angle down into the foundation, the second component extending from the first component adjacent only one of the first and second edges, the second component transmitting shear forces exerted on the anchor rods by the wall into the foundation.

2. The anchorage assembly recited in claim 1, wherein the first component is provided substantially vertically within the foundation.

3. The anchorage assembly recited in claim 1, further comprising a second component formed integrally with the first component, the second component including one or more holes through which the one or more anchor rods are positioned.

4. The anchorage assembly recited in claim 3, wherein the second component includes a surface substantially flush with an upper surface of the foundation.

5. The anchorage assembly recited in claim 3, further comprising a template for positioning the anchorage assembly within the foundation, the template positioned above an upper surface of the second component.

6. The anchorage assembly recited in claim 5, wherein the template includes a surface substantially flush with an upper surface of the foundation.

7. The anchorage assembly recited in claim 3, wherein the number of holes and anchor rods is two.

8. The anchorage assembly recited in claim 3, wherein the number of holes and anchor rods is four.

9. The anchorage assembly recited in claim 1, wherein the foundation is concrete.

10. The anchorage assembly recited in claim 1, wherein the shear lug is ASTM A36 steel.

11. A framing member affixed to a foundation, the framing member comprising:

a structural member supported on the foundation and extending perpendicularly to the foundation;

one or more anchor rods installed in the foundation with a portion of each anchor rod extending out of the foundation, the structural member affixed directly to the one or more anchor rods; and a shear lug having a first component including one or more holes receiving the one or more anchor rods to affix the one or more anchor rods directly to the shear lug, and a second component provided at an angle to the first component, the second component being buried in the foundation and having first and second surfaces in contact with the foundation, the second component having no contact with the one or more anchor rods, the shear lug capable of transmitting shear forces exerted on the one or more anchor rods by the structural member into the foundation.

12. The framing member recited in claim 11, wherein the first and second components are at substantially right angles to each other.

13. The framing member recited in claim 11, wherein the first and second components are at oblique angles with respect to each other.

14. The framing member recited in claim 11, wherein the first and second components come together at their edges.

15. The framing member recited in claim 14, wherein the number of holes in the first component is two.

16. The framing member recited in claim 11, wherein the second component extends down from a central portion of the first component.

17. The framing member recited in claim 16, wherein the number of holes in the first component is four.

18. The framing member recited in claim 11, wherein the first component includes a surface substantially flush with an upper surface of the foundation.

19. The framing member recited in claim 11, wherein the foundation is concrete.

20. The framing member recited in claim 11, wherein the shear lug is ASTM A36 steel.

21. A method of transferring shear forces from a structural element to a foundation on which the structural element is supported, comprising the steps of:

(a) mounting a shear lug within a foundation prior to the foundation hardening, the shear lug having a first component having a hole for receiving an anchor rod, and a second component extending at an angle to the first component down into the foundation;

(b) mounting the anchor rod through the hole in the first component of the shear lug and within the foundation prior to the foundation hardening, a portion of the one or more anchor rods extending above the foundation and no portion of the anchor rod contacting the second component; and (c) mounting the structural element to the portion of the one or more anchor rods extending above the foundation.

22. The method of claim 21, wherein said step (a) comprises the step of affixing the shear lug to a template and affixing the template to a form used to define an upper surface of the foundation when the foundation is formed.

23. The method of claim 21, further comprising the step (d) of forming the shear lug of a single piece of steel bent into first and second components at substantially a right angle to each other.

24. The method of claim 21, further comprising the step (e) of forming the shear lug of a pair of angled steel pieces affixed back to back to each other to provide a first portion and a second portion extending at a substantially right angle to the first portion from a central section of the first portion.

* * * * *